US007340831B2

(12) United States Patent
Yamaguchi et al.

(10) Patent No.: US 7,340,831 B2
(45) Date of Patent: Mar. 11, 2008

(54) METHOD FOR MAKING LIQUID DISCHARGE HEAD

(75) Inventors: Nobuhito Yamaguchi, Tokyo (JP); Akihiro Mouri, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 703 days.

(21) Appl. No.: 10/887,812

(22) Filed: Jul. 12, 2004

(65) Prior Publication Data

US 2005/0012788 A1 Jan. 20, 2005

(30) Foreign Application Priority Data

Jul. 18, 2003 (JP) ..... 2003-198856

(51) Int. Cl.
*B21D 53/76* (2006.01)
*B41J 2/045* (2006.01)

(52) U.S. Cl. ..... 29/890.1; 29/25.35; 29/832; 29/835; 29/890.09; 347/68

(58) Field of Classification Search ..... 29/890.1, 29/25.35, 832, 835, 890.09, 614, 611; 347/40, 347/47, 68–70; 216/27, 41, 87, 89, 43, 94; 427/58, 97.7, 534, 554
See application file for complete search history.

(56) References Cited

U.S. PATENT DOCUMENTS 4,367,478 A 1/1983 Larsson
4,418,355 A 11/1983 DeYoung et al.
4,525,728 A * 6/1985 Koto ..... 347/70
4,994,825 A * 2/1991 Saito et al. ..... 347/63
5,983,486 A * 11/1999 Shimomura et al. ..... 29/611
6,109,734 A * 8/2000 Kashino et al. ..... 347/65
6,233,405 B1 * 5/2001 Oikawa et al. ..... 29/25.35
2004/0017440 A1 1/2004 Takayama et al.
2004/0021745 A1 2/2004 Mouri et al.

FOREIGN PATENT DOCUMENTS

JP 63-25942 5/1988

* cited by examiner

*Primary Examiner*—A. Dexter Tugbang
*Assistant Examiner*—Tai Van Nguyen
(74) *Attorney, Agent, or Firm*—Fitzpatrick, Cella, Harper & Scinto

(57) ABSTRACT

A method for making a liquid discharge head including liquid discharge openings, a liquid channel having pressure chambers communicating with the liquid discharge openings, and piezoelectric elements corresponding to the pressure chambers and arranged in the form of teeth of a comb includes the steps of filling gaps between the piezoelectric elements with a filler; forming a liquid channel pattern on a flat surface including the end faces of the piezoelectric elements and the filler filling the gaps between the piezoelectric elements; forming a coating layer on the liquid channel pattern; and removing the liquid channel pattern to form the pressure chambers.

13 Claims, 7 Drawing Sheets

METHOD FOR MAKING LIQUID DISCHARGE HEAD

BACKGROUND OF THE INVENTION

1. Field of the Invention

The present invention relates to a method for making a liquid discharge head for use in head cartridges and liquid discharging devices that produce droplets by an inkjet (liquid jet) technique.

The present invention also relates to a method for making a liquid discharge head for use in devices, such as printers, copy machines, fax machines with communication systems, and word processors with printer units, that can record objects onto recording media composed of paper, threads, fibers, textile, leather, metal, plastic, glass, wood, ceramic, or the like. Here, the term "object" includes images that have meaning, such as alphabetic characters and drawings, and images that do not have any meaning, such as patterns.

2. Description of the Related Art

A typical liquid discharge head of a liquid jet recording device capable of discharging droplets on demand includes a nozzle plate having a plurality of nozzle openings, a diaphragm opposing the nozzle plate and having portions that undergo elastic deformation when piezoelectric elements (piezoelectric vibrators) are driven, and pressure chambers formed between the nozzle plate and the diaphragm. In operation, ink flows into the chambers by the contraction and expansion of the piezoelectric elements, and is subsequently discharged in the form of droplets from the nozzle openings by expansion of the piezoelectric elements. In order to improve the bonding state between the piezoelectric elements and the diaphragm, for example, a bonding member is typically disposed between the piezoelectric element and the diaphragm to efficiently transfer the deformation of the piezoelectric element to the pressure chamber, as disclosed, for example, in U.S. Pat. No. 4,418,355. Japanese Examined Patent Application Publication No. 63-25942 teaches leg members to yield the same effect.

According to these conventional approaches, the piezoelectric elements and components of the pressure chambers are separately prepared and then bonded. As a result, the bonding process requires high-precision alignment, resulting in high manufacturing costs. If the high-precision alignment fails during the bonding process, the deformation of the piezoelectric elements may not efficiently be transmitted to the pressure chambers or the deformation may be transmitted to portions other than targeted positions. This leads to a problem of cross talk, i.e., unstable behavior of nozzle meniscuses.

SUMMARY OF THE INVENTION

It is an object of the present invention to provide a method for making a liquid discharge head that does not require any step of bonding the piezoelectric elements to the diaphragm. According to this method, the liquid channel part, i.e., the structure including pressure chambers and the associated components, is integrally formed on the piezoelectric elements. Another object of the present invention is to provide a method for making a liquid discharge head that can efficiently transmit the deformation of the piezoelectric elements to the pressure chambers and prevent cross talk as much as possible.

To achieve these objects, a first aspect of the present invention provides a method for making a liquid discharge head including liquid discharge openings, a liquid channel having pressure chambers communicating with the liquid discharge openings, and piezoelectric elements corresponding to the pressure chambers and arranged in the form of teeth of a comb, the method including the steps of (a) filling the gaps between the piezoelectric elements with a filler; (b) forming a liquid channel pattern on a flat surface including the end faces of the piezoelectric elements and the filler filling the gaps between the piezoelectric elements; (c) forming a coating layer on the liquid channel pattern; and (d) removing the liquid channel pattern to form the pressure chambers.

A second aspect of the present invention provides a method for making a liquid discharge head including liquid discharge openings, a liquid channel including pressure chambers communicating with the liquid discharge openings, and piezoelectric elements aligned to correspond with the pressure chambers, the method including the steps of filling gaps between the piezoelectric elements with a filler; forming a liquid channel pattern on a flat surface including the end faces of the piezoelectric elements and the filler filling the gaps between the piezoelectric elements; forming a coating layer on the liquid channel pattern; and removing the liquid channel pattern to form the pressure chambers.

Since the liquid channel part is integrally formed on the flat surface using a coating resin layer, the risk of misalignment between the piezoelectric elements and the pressure chambers can be eliminated. As a result, the vibration of a piezoelectric element does not affect the pressure chambers corresponding to the adjacent piezoelectric elements. Moreover, the pressure can be uniformly propagated over a wide spatial range orthogonal to the row of nozzle openings. Thus, a precision, high-performance liquid discharge head that can efficiently transmit the deformation of the piezoelectric element, prevent the propagation of the deformation to adjacent pressure chambers, and uniformly maintain nozzle meniscuses can be easily manufactured at a low cost.

It is also possible to easily control the distance between the piezoelectric element and the liquid discharge opening and to achieve high precision alignment with the center of the liquid discharge opening. Since the position of the liquid discharge opening can be accurately aligned and the distance between the liquid discharge opening and the corresponding pressure chamber can be reduced, a liquid discharge head operating at high frequencies can be prepared. Furthermore, a liquid discharge head having stable discharge characteristics suitable for high quality printing can be manufactured at a low cost.

Further objects, features and advantages of the present invention will become apparent from the following description of the preferred embodiments with reference to the attached drawings.

DESCRIPTION OF THE PREFERRED EMBODIMENTS

Figure 1:
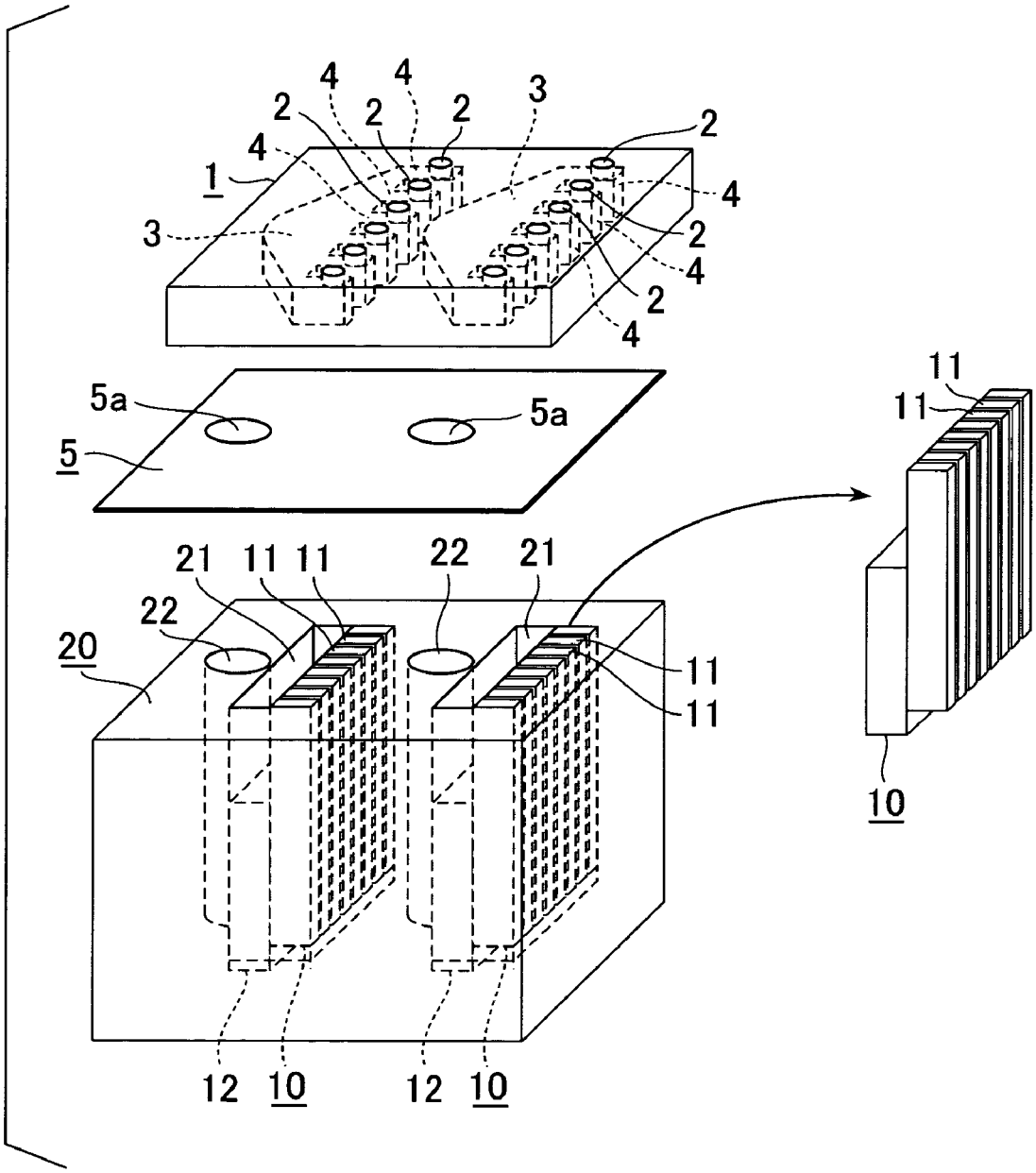
FIG. 1 is a schematic exploded view of a liquid discharge head according to an embodiment of the present invention.

The present invention will now be described with reference to the drawings. FIG. 1 shows the schematic structure of a liquid discharge head immediately before finishing, according to an embodiment of the present invention. For the purpose of explanation, the head is divided into a top part, i.e., a nozzle part or liquid channel part, and a bottom part, i.e., a piezoelectric element part.

A coating resin layer 1 of the nozzle part has two nozzle rows each including a plurality of liquid discharge openings (nozzle openings) 2. In the coating resin layer 1, liquid reservoirs (liquid channels) 3 and pressure chambers 4 are formed by patterning a soluble resin and removing the soluble resin, as described below.

A diaphragm 5 is disposed between the top part and the bottom part. The diaphragm 5 has two openings 5*a* that respectively communicate with the two liquid reservoirs 3 of the coating resin layer 1. One surface of the diaphragm 5 opposes the liquid discharge openings 2 with the pressure chambers 4 therebetween. The other surface of the diaphragm 5 abuts against tips of piezoelectric elements 11 (e.g., piezoelectric vibrators) of two vibrator units 10 of the piezoelectric element part. The contraction and expansion of the piezoelectric elements 11 are transmitted to the liquid in the pressure chambers 4 via the diaphragm 5.

The vibrator units 10 are accommodated in a head casing 20. The head casing 20 has receivers 21 for accommodating the vibrator units 10 and liquid supply ports 22 communicating with the openings 5*a* of the diaphragm 5.

The piezoelectric elements 11 in each vibrator unit 10 mechanically vibrate to generate energy, and the generated energy is transmitted to a liquid inside the pressure chamber 4 via the diaphragm 5 so that the liquid can be discharged in the form of droplets to record an object onto a medium. In other words, the piezoelectric elements 11 function as devices for generating energy for discharging a liquid (ink). Each vibrator unit 10 also includes a controller (not shown) for driving the piezoelectric elements 11.

Figure 2A:
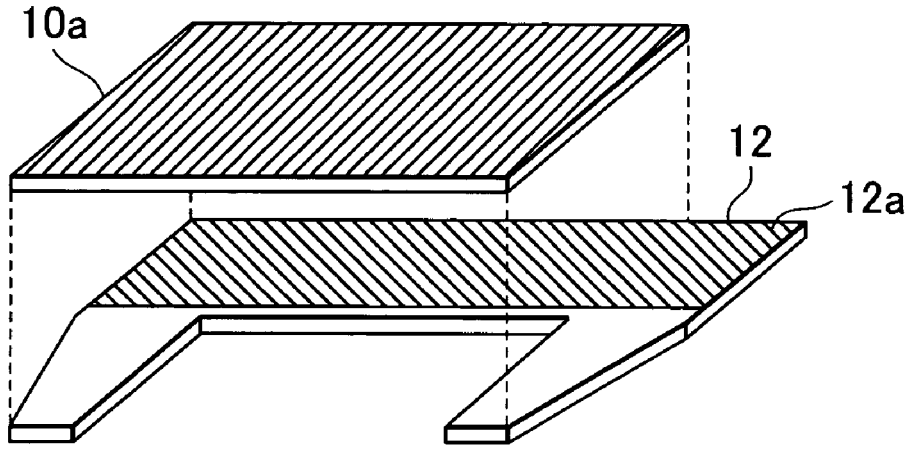
FIGS. 2A and 2B are schematic views for explaining the steps of forming a vibrator unit.
Figure 2B:
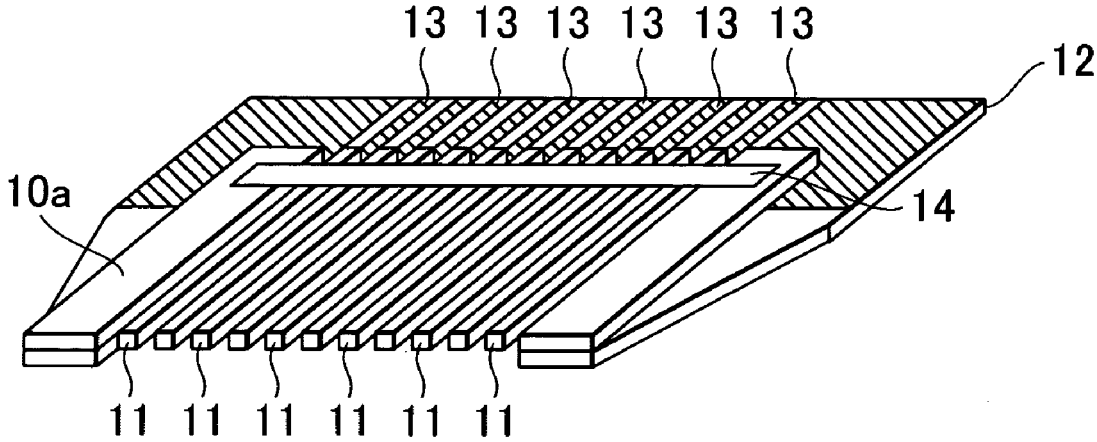

FIGS. 2A and 2B are schematic diagrams for explaining the detailed structure of each vibrator unit 10. The vibrator unit 10 is prepared by making cuts in a piezoelectric plate 10*a* from one edge to the opposite edge at a pitch corresponding to the alignment pitch of the pressure chambers 4 so that a plurality of piezoelectric elements 11 are formed. For performing cutting, for example, the depth of a cut of a dicing saw is adjusted in advance so that a thin-film electrode 12*a* placed on a support 12 is also cut in the same cutting step to form leads 13 for supplying drive signals. The piezoelectric elements 11 are supported by the support 12, and a conductive plate, i.e., a common electrode 14, is bonded onto the surface of the piezoelectric elements 11 with a conductive adhesive. When a drive signal is supplied from the controller to the leads 13 and the common electrode 14, the piezoelectric elements 11 expand and contract in the longitudinal direction.

Figure 3A:
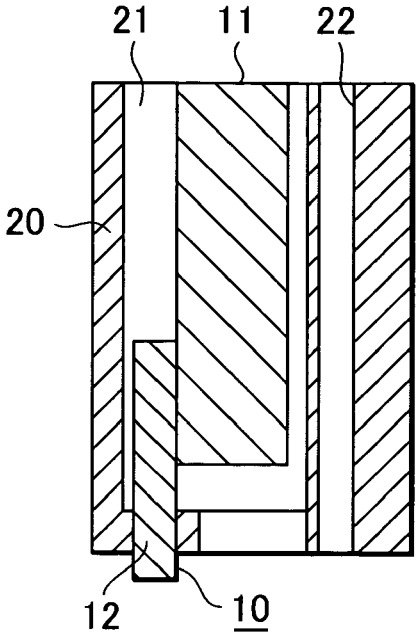
FIGS. 3A and 3B are schematic cross-sectional views of a bottom part of the liquid discharge head respectively taken in the longitudinal direction and transverse direction of a piezoelectric element.
Figure 3B:
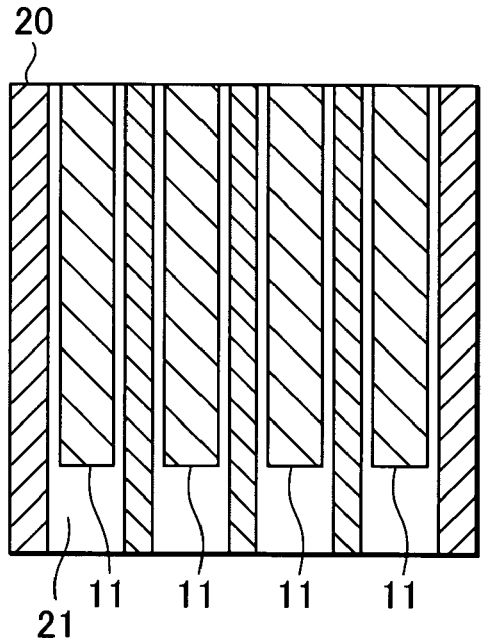

Referring now to FIGS. 3A and 3B, the vibrator unit 10 is placed in the head casing 20 so that the end faces of the piezoelectric elements 11, arranged in the form of teeth of a comb, are substantially flush with the outer surface of the head casing 20. The diaphragm 5 and then the coating resin layer 1 are formed on this flat surface.

FIGS. 4A to 10B are cross-sectional views for explaining the steps of a process for forming the nozzle part. First, the gaps between the piezoelectric elements 11 of the vibrator unit 10, the spaces in the receiver 21 of each vibrator unit 10 of the head casing 20, and the space defining the liquid supply port 22 are filled with fillers, i.e., soluble resins 31 and 32. As is described below, the resin 31 that fills the space in the receiver 21 of the vibrator unit 10 or the gaps between the piezoelectric elements 11 may be insoluble if no filler removal is planned at the later stage.

Next, the surface 20*a* including the end faces of the piezoelectric elements 11 and the resin 31 filling the gaps between the piezoelectric elements 11 is polished to form a smooth, flat surface. As a result, the diaphragm 5 and the coating resin layer 1 can be formed to desired thicknesses not exceeding 50 μm on this flat surface by an appropriate application method, e.g., spin coating, roller coating, or the like at high accuracy. In this manner, materials that cannot be processed by dry film methods, i.e., materials having poor coatability, can be used to form the diaphragm 5 and the coating resin layer 1.

In forming the coating resin layer 1 and the like on the surface 20*a* by the application of resins, the piezoelectric elements 11 of the vibrator units 10, the pressure chambers 4, and the liquid discharge openings 2 must be accurately aligned. Thus, in the patterning process described below, the resin is preferably directly patterned using alignment means that is formed on the piezoelectric elements 11 or the vibrator units 10 and can be visually observed through the resin.

Figure 5A:
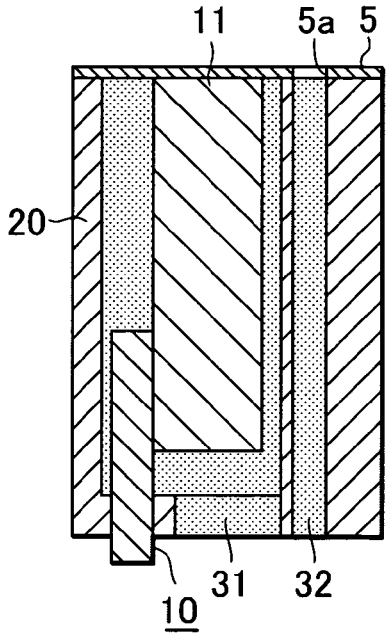
FIGS. 5A and 5B are schematic cross-sectional views respectively taken in the longitudinal direction and transverse direction of the piezoelectric element, showing the second step of the process for making the liquid discharge head.
Figure 5B:
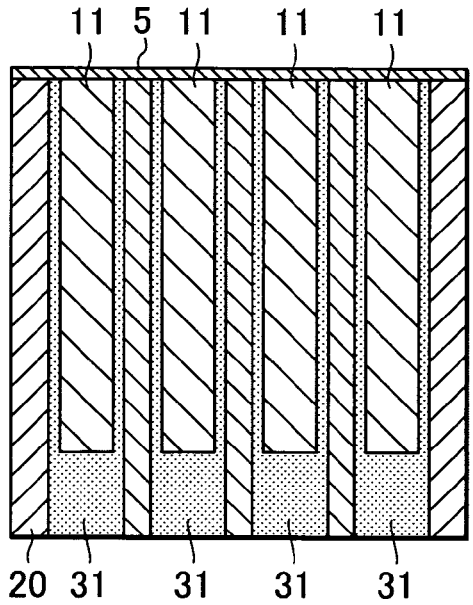

First, as shown in FIGS. 5A and 5B, a photosensitive resin layer is formed by spin coating or roller coating and patterned to form the diaphragm 5 having the openings 5*a* corresponding to the liquid supply ports 22.

The resin used to form the diaphragm 5 must have high mechanical strength, heat resistance, ability to adhere to the substrate, and resistance to liquids such as ink, and must not affect the properties of such liquids.

Figure 6A:
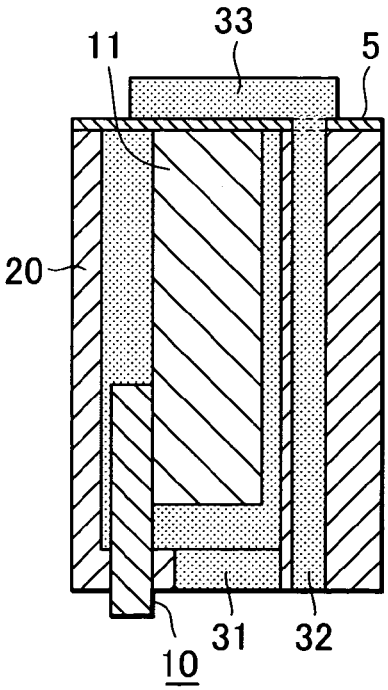
FIGS. 6A and 6B are schematic cross-sectional views respectively taken in the longitudinal direction and transverse direction of the piezoelectric element, showing the third step of the process for making the liquid discharge head.
Figure 6B:
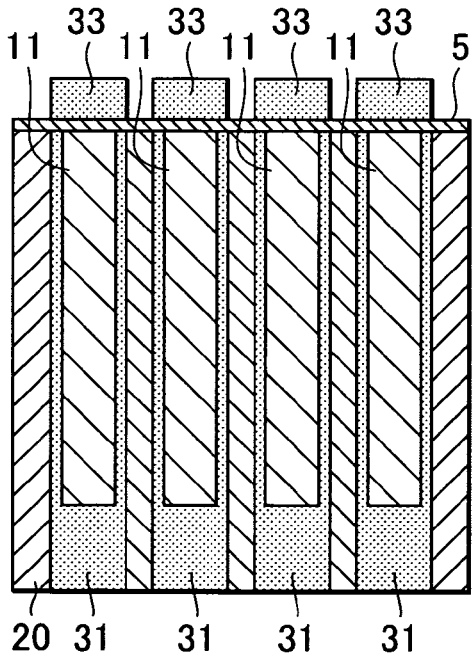

Referring now to FIGS. 6A and 6B, a soluble resin is applied by spin coating or roller coating and patterned to form a resin pattern 33, i.e., a liquid channel pattern shaped to form the liquid reservoirs 3 and the pressure chambers 4.

Figure 7A:
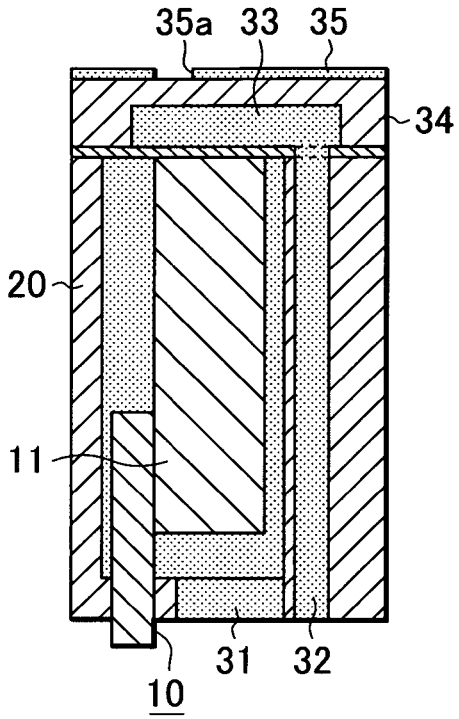
FIGS. 7A and 7B are schematic cross-sectional views respectively taken in the longitudinal direction and transverse direction of the piezoelectric element, showing the fourth step of the process for making the liquid discharge head.
Figure 7B:
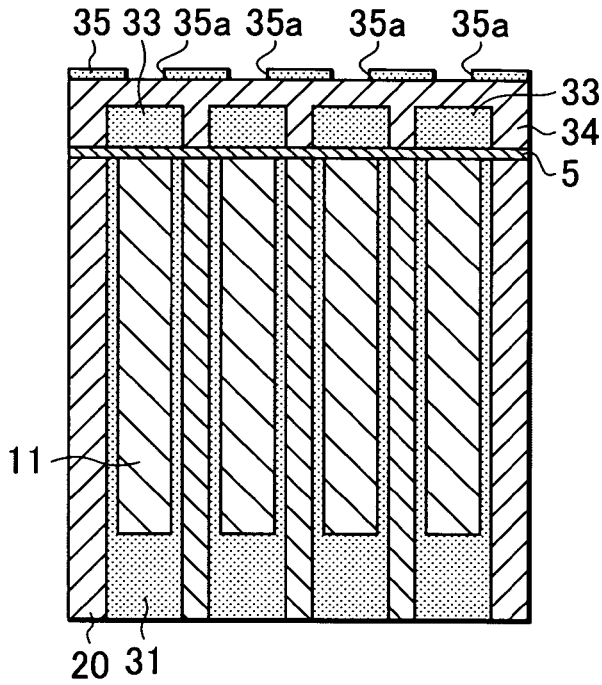

Referring now to FIGS. 7A and 7B, a resin layer 34, which is the precursor of the coating resin layer 1, is formed on the resin pattern 33. The resin used to form the resin layer 34 must also have high mechanical strength, heat resistance, ability to adhere to the substrate, and resistance to liquids such as ink, and must not affect the properties of such liquids since the resin layer 34 is a constituent of the liquid discharge head. The resin layer 34 is preferably composed of a resin that polymerizes and cures by light or thermal energy and that exhibits high adhesion to the substrate.

Figure 11A:
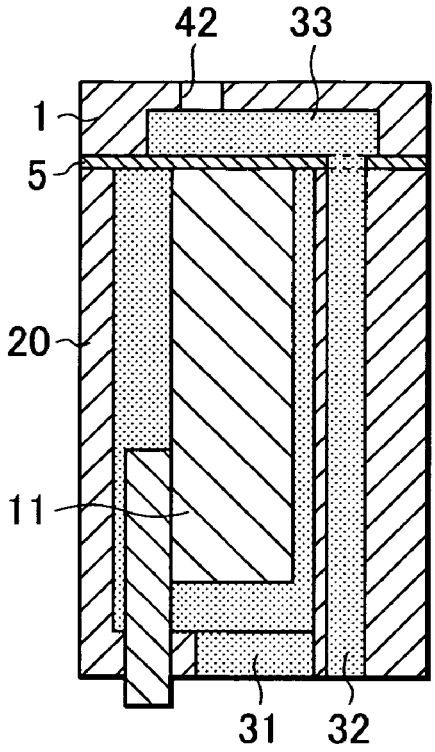
FIGS. 11A and 11B are schematic cross-sectional views respectively taken in the longitudinal direction and transverse direction of the piezoelectric element, explaining the step of forming liquid discharge openings by photolithography.
Figure 11B:
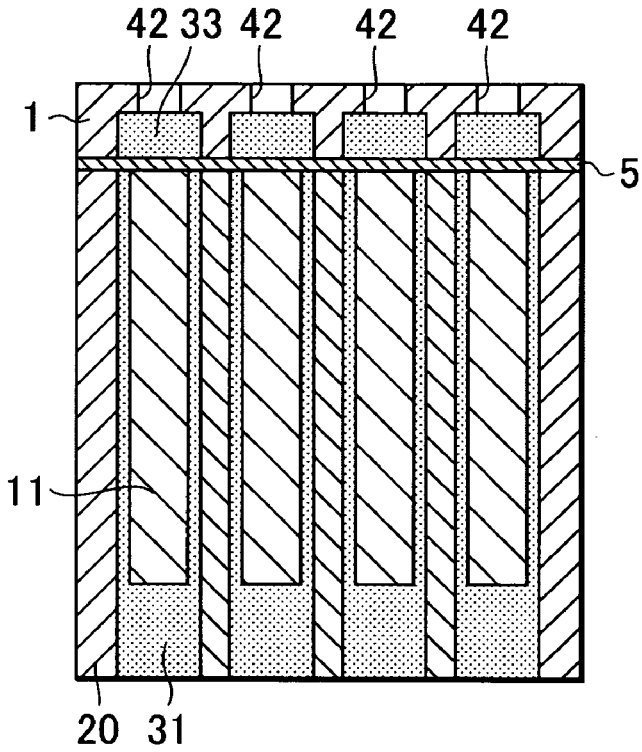

Next, a resist for forming the liquid discharge openings in the resin layer 34 is applied to form a resist layer 35 with openings 35*a*. As shown in FIGS. 11A and 11B, when the resin layer 34 is photosensitive, the liquid discharge openings 42 are formed by photolithographic patterning. Alternatively, the liquid discharge openings 2 may be made by excimer laser processing, oxygen plasma etching, or the like (see FIGS. 8A and 8B) in the resin layer 34 cured in advance.

Figure 9A:
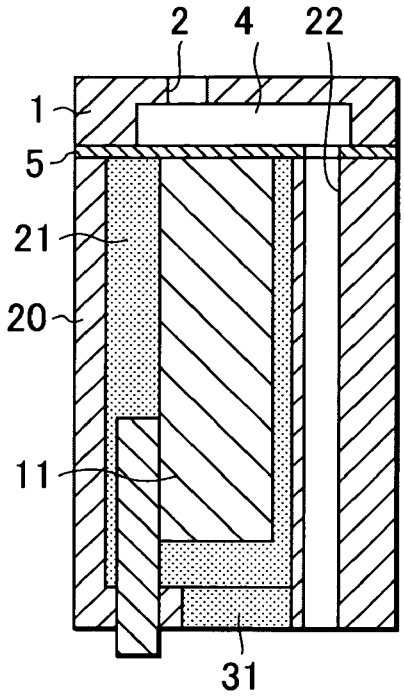
FIGS. 9A and 9B are schematic cross-sectional views respectively taken in the longitudinal direction and transverse direction of the piezoelectric element, showing the sixth step of the process for making the liquid discharge head.
Figure 9B:
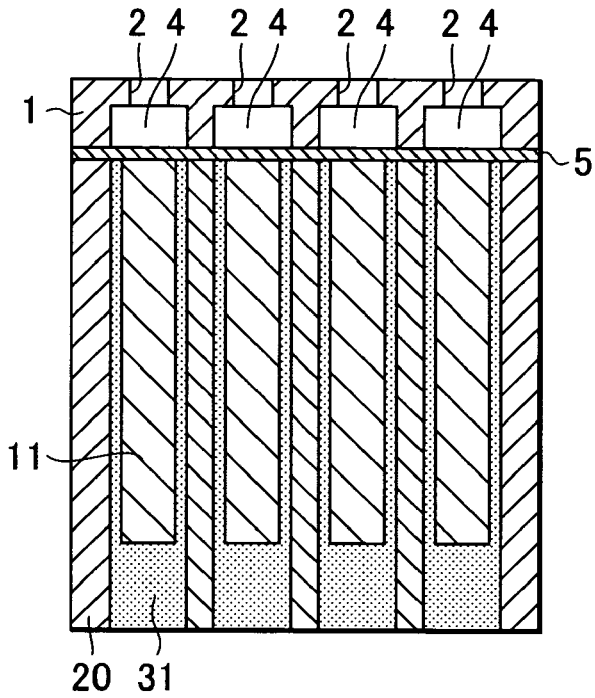
Figure 10A:
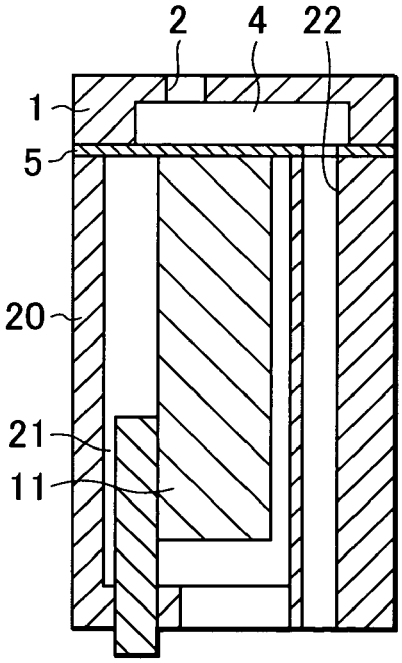
FIGS. 10A and 10B are schematic cross-sectional views respectively taken in the longitudinal direction and transverse direction of the piezoelectric element, showing the seventh step of the process for making the liquid discharge head.
Figure 10B:
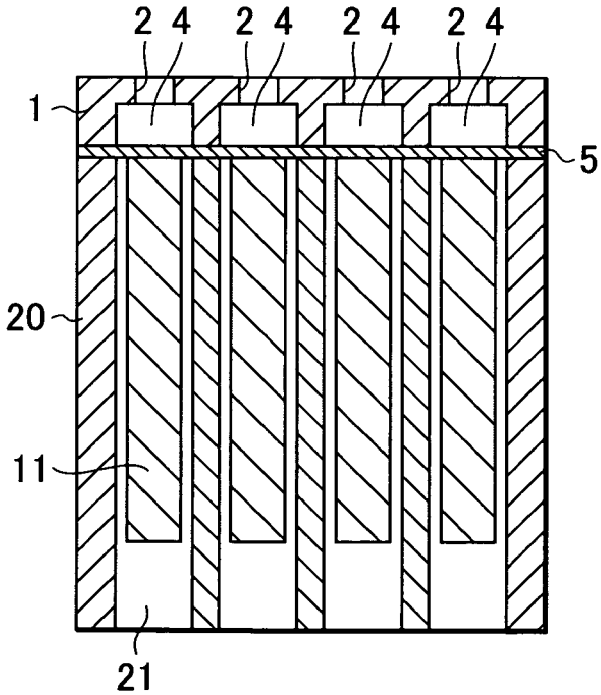

Referring now to FIGS. 9A and 9B, the resin 32 in the liquid supply port 22, the resin pattern 33, the resist layer 35, and the like are removed with a solvent. Referring to FIGS. 10A and 10B, the resin 31 filling the gap between the piezoelectric elements 11 of the vibrator units 10 and the receiver 21 of the head casing 20 is then removed with a solvent. As is previously described, this last step may be omitted to leave the resin 31 in the receiver 21.

The coating resin layer 1 having the pressure chambers 4 and the like and prepared as described above is bonded with components for supplying a liquid, and electrical connections for driving the piezoelectric elements 11 are formed to complete fabrication of the liquid discharge head.

EXAMPLES

The method of making a liquid discharge head according to the steps shown in FIGS. 2 to 10B will now be described by way of examples.

Example 1

The vibrator unit 10 having the piezoelectric elements 11 was first prepared to function as the element for generating discharge energy.

In particular, layers composed of a piezoelectric material and layers composed of an electrode material were alternately stacked to form a piezoelectric plate 10*a* constituted of twenty layers and capable of operating at a low voltage, e.g., about 24 V. Referring to FIG. 2, a portion of the piezoelectric plate 10*a* was fixed using a conductive adhesive KE 3492 (Shin-Etsu Chemical Co., Ltd.) onto the thin-film electrode 12*a* disposed on the support 12. The piezoelectric plate 10*a* was cut from the free end in the cutout of the support 12 across to the opposite end so as to form piezoelectric elements 11 at a pitch corresponding to the alignment pitch of the pressure chambers 4. The depth of cuts of a dicing saw was adjusted in advance so that the thin-film electrode 12*a* was cut to simultaneously form leads 13 for supplying drive signals. In the dicing step of this example, the width of a cut was 90 μm, the thickness of the piezoelectric plate 10*a* was 500 μm, and the depth of a cut was 550 μm.

A conductive plate, i.e., the common electrode 14, was bonded on the surface of the piezoelectric elements 11 remote from the support 12 using a conductive adhesive. This structure allows expansion and contraction of the piezoelectric elements 11 in the longitudinal direction when a driving signal is supplied from the leads 13 and the common electrode 14.

As shown in FIGS. 3A and 3B, each vibrator unit 10 was placed in the head casing 20 so that the end faces of the piezoelectric elements 11 were substantially flush with the outer surface of the head casing 20.

Figure 4A:
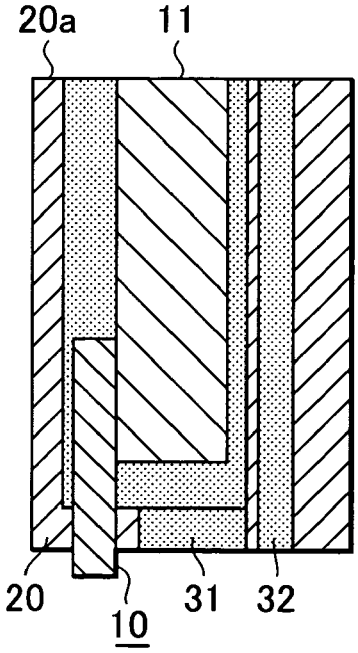
FIGS. 4A and 4B are schematic cross-sectional views respectively taken in the longitudinal direction and transverse direction of the piezoelectric element, showing the first step of the process for making the liquid discharge head.
Figure 4B:
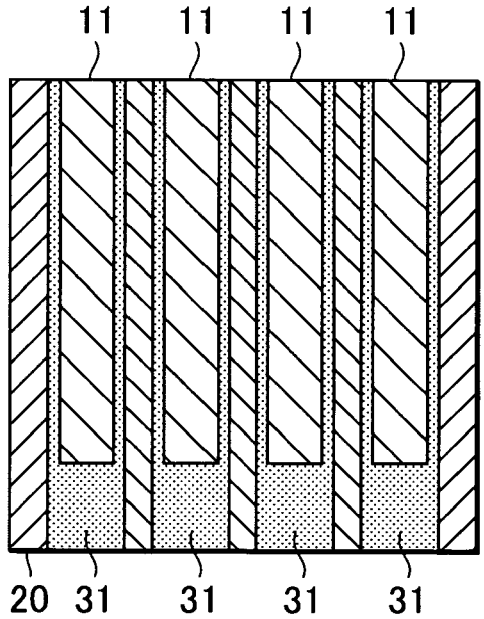

As shown in FIGS. 4A and 4B, the gaps between the piezoelectric elements 11, the space in the receiver 21 of the head casing 20, and the space defining the liquid supply port 22 were filled with soluble resins 31 and 32 (PMER A-900, manufactured by Tokyo Ohka Kogyo Co., Ltd.). The surface 20*a* was polished to form a smooth, flat surface.

Referring to FIGS. 5A and 5B, a photosensitive resin layer was formed by applying an alicyclic epoxy resin (EHPE-3150, manufactured by Daicel Chemical Industries, Ltd.) containing a 4,4'-di-t-butyldiphenyliodonium hexafluoroantimonate/copper triflate mixed catalyst on the flat surface by spin coating. The photosensitive resin layer was patterned to form the diaphragm 5 having the openings 5*a* corresponding to the liquid supply ports 22.

As shown in FIGS. 6A and 6B, PMER A-900 (manufactured by Tokyo Ohka Kogyo Co., Ltd.) was applied by spin coating to form a soluble resin layer. The soluble resin layer was patterned and developed using a Mask Aligner MPA-600 (manufactured by Canon Kabushiki Kaisha) to form the resin pattern 33 for making the liquid reservoirs 3 and the pressure chambers 4.

PMER A-900 is a novolac resist exhibiting high resolution and stable patterning characteristics but is generally not suitable for dry film methods due to its low coatability. However, in the present invention, the surface of the diaphragm 5 is highly smooth and flat. Thus, a novolac resist can be used to form a film having a desired thickness by spin coating.

Next, as shown in FIGS. 7A and 7B, the resin layer 34, i.e., the precursor of the coating resin layer 1, was formed on the resin pattern 33 by spin coating. In this example, an alicyclic epoxy resin (EHPE-3150, manufactured by Daicel Chemical Industries, Ltd.) was thermally cured in the presence of a cationic polymerization catalyst, namely, a 4,4'-di-t-butyldiphenyliodonium hexafluoroantimonate/copper triflate mixed catalyst, to form the resin layer 34. An epoxy resin cationically polymerized by heating or photoreaction has high mechanical strength, ability to adhere to the substrate, and resistance to ink, which are desirable properties for a constituent of a liquid discharge head.

Figure 8A:
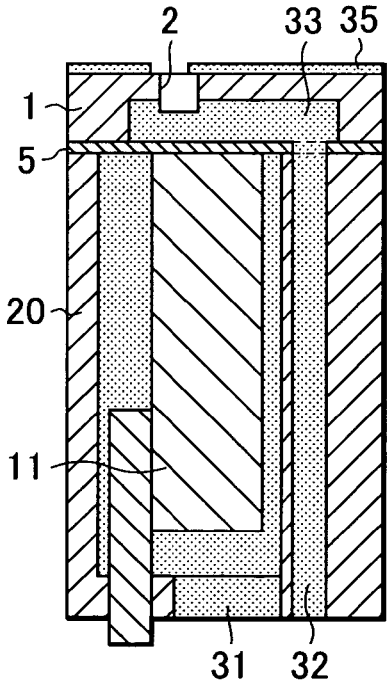
FIGS. 8A and 8B are schematic cross-sectional views respectively taken in the longitudinal direction and transverse direction of the piezoelectric element, showing the fifth step of the process for making the liquid discharge head.
Figure 8B:
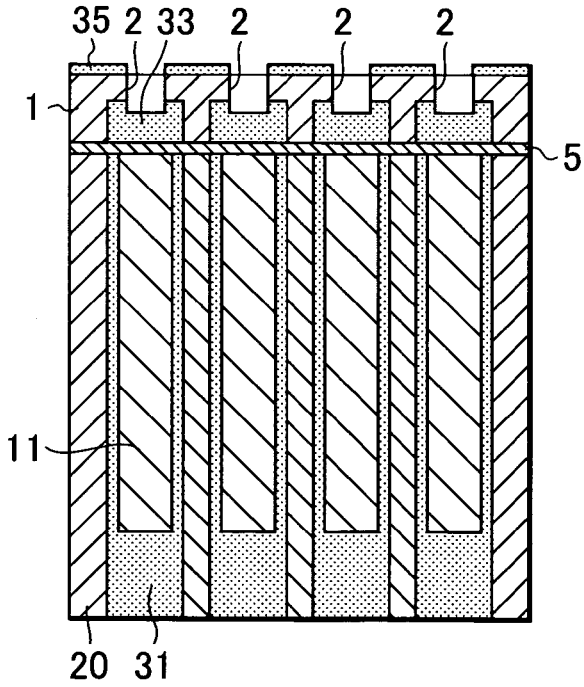

Next, a silicon-containing positive resist FH-SP (manufactured by Fuji Hunt Kabushiki Kaisha) was applied on the resin layer 34 to form the resist layer 35. The resist layer 35 was patterned to form the openings 35*a*. Referring to FIGS. 8A and 8B, the resin layer 34 was then oxygen plasma etched through the resist layer 35 functioning as an oxygen plasma resistance layer so as to form the liquid discharge openings 2. The etching was stopped after the resin pattern 33 became exposed in each liquid discharge opening 2, to prevent damage to the diaphragm 5.

The resin 32 filling the liquid supply port 22, the resin pattern 33, and the FH-SP resist layer 35 shown in FIGS. 8A and 8B were removed by washing, as shown in FIGS. 9A and 9B. The resin 31 was then removed, as shown in FIGS. 10A and 10B. The resin 32, the resin pattern 33, the resist layer 35, and the resin 31 may be removed in one step to simplify the manufacturing process.

Next, components for supplying liquid are bonded, and electrical connections for signal input were formed to prepare a liquid discharge head.

The liquid discharge head was mounted on a recording apparatus. Recording was performed using an ink containing 79.4 percent by weight of deionized water, 15 percent by weight of diethylene glycol, 3 percent by weight of isopropyl alcohol, 0.1 percent by weight of lithium acetate, and 2.5 percent by weight of Food Black 2 (black dye). High quality printouts were obtained.

Example 2

The resin pattern 33 was formed using PMER A-900 as the soluble resin material, and the resin layer 34, i.e., the precursor of the coating resin layer 1, was formed as in EXAMPLE 1 through steps shown in FIGS. 6A to 7B. The resin layer 34 was made from the same material as in EXAMPLE 1. Since the 4,4'-di-t-butyldiphenyliodonium hexafluoroantimonate/copper triflate mixed catalyst can also be used to conduct photolithography, a photolithographic technique was used to form liquid discharge openings 42, as shown in FIGS. 11A and 11B. In particular, the resin layer 34 was exposed and developed using a Mask Aligner PLA520 (cold mirror 250) manufactured by Canon Kabushiki Kaisha to form the liquid discharges opening 42.

The resin pattern 33 and the resin 32 in the liquid supply port 22 were removed. Components for supplying liquid were bonded, and electrical connections for signal input were formed as in EXAMPLE 1 to prepare a liquid discharge head. High quality printouts were obtained using this head.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for making a liquid discharge head comprising liquid discharge openings, a liquid channel having pressure chambers communicating with the liquid discharge openings, and piezoelectric elements corresponding to the pressure chambers and arranged in the form of teeth of a comb, the method comprising the steps of:

(a) filling gaps between the piezoelectric elements with a filler;

(b) forming a liquid channel pattern on a flat surface including end faces of the piezoelectric elements and the filler filling the gaps between the piezoelectric elements;

(c) forming a coating layer on the liquid channel pattern; and (d) removing the liquid channel pattern to form the pressure chambers, wherein the liquid channel pattern is light-transmissive, and in step (b), the liquid channel pattern is aligned using alignment means provided to the piezoelectric elements, the alignment means being visible through the light-transmissive liquid channel pattern.

2. A method for making a liquid discharge head comprising liquid discharge openings, a liquid channel having pressure chambers communicating with the liquid discharge openings, and piezoelectric elements corresponding to the pressure chambers and arranged in the form of teeth of a comb, the method comprising the steps of:

(a) filling gaps between the piezoelectric elements with a filler;

(b) forming a liquid channel pattern on a flat surface including end faces of the piezoelectric elements and the filler filling the gaps between the piezoelectric elements;

(c) forming a coating layer on the liquid channel pattern;

(d) removing the liquid channel pattern to form the pressure chambers; and (e) removing the filler after step (d).

3. The method according to claim 2, wherein the coating layer comprises a resin, and the liquid discharge openings are formed in the coating layer by plasma etching.

4. The method according to claim 2, wherein the filler is a soluble resin.

5. The method according to claim 2, wherein, in step (a), a liquid supply port for supplying a liquid to the liquid channel is filled with the filler, and, in step (e), the filler is removed from the liquid supply port.

6. The method according to claim 2, wherein the piezoelectric elements are piezoelectric vibrators.

7. A method for making a liquid discharge head comprising liquid discharge openings, a liquid channel having pressure chambers communicating with the liquid discharge openings, and piezoelectric elements corresponding to the pressure chambers and arranged in the form of teeth of a comb, the method comprising the steps of:

(a) filling gaps between the piezoelectric elements with a filler;

(b) forming a liquid channel pattern on a flat surface including end faces of the piezoelectric elements and the filler filling the gaps between the piezoelectric elements;

(c) forming a coating layer on the liquid channel pattern; and (d) removing the liquid channel pattern to form the pressure chambers, wherein the coating layer comprises a resin, and the liquid discharge openings are formed in the coating layer by photolithography.

8. The method according to claim 7, wherein the flat surface is formed by polishing.

9. The method according to claim 7, wherein a diaphragm is formed on the flat surface, and the liquid channel pattern is formed on a diaphragm.

10. The method according to claim 7, further comprising a step of disposing the piezoelectric elements in a head casing in such a fashion that the end faces of the piezoelectric elements are substantially flush with an outer surface of the head casing.

11. The method according to claim 7, wherein the piezoelectric elements are piezoelectric vibrators.

12. A method for making a liquid discharge head comprising liquid discharge openings, a liquid channel having pressure chambers communicating with the liquid discharge openings, and piezoelectric elements corresponding to the pressure chambers and arranged in the form of teeth of a comb, the method comprising the steps of:

(a) filling gaps between the piezoelectric elements with a filler;

(b) forming a liquid channel pattern on a flat surface including end faces of the piezoelectric elements and the filler filling the gaps between the piezoelectric elements;

(c) forming a coating layer on the liquid channel pattern; and (d) removing the liquid channel pattern to form the pressure chambers, wherein the coating layer comprises a resin, and the liquid discharge openings are formed in the coating layer by excimer laser processing.

13. A method for making a liquid discharge head comprising liquid discharge openings, a liquid channel having pressure chambers communicating with the liquid discharge openings, and piezoelectric elements corresponding to the pressure chambers and arranged in the form of teeth of a comb, the method comprising the steps of:

(a) filling gaps between the piezoelectric elements with a filler;

(b) forming a liquid channel pattern on a flat surface including end faces of the piezoelectric elements and the filler filling the gaps between the piezoelectric elements;

(c) forming a coating layer on the liquid channel pattern; and (d) removing the liquid channel pattern to form the pressure chambers; and (e) a cutting step of cutting a piezoelectric plate to form the arrangement of piezoelectric elements in the form of teeth of a comb and of cutting an electrode to form leads for supplying driving signals to the piezoelectric elements.

* * * * *